US007935034B2

(12) United States Patent
Oh

(10) Patent No.: US 7,935,034 B2
(45) Date of Patent: May 3, 2011

(54) CLAPPING MARTIAL ARTS STRIKING TARGET

(75) Inventor: Jonathan Oh, San Jose, CA (US)

(73) Assignee: Pioneer Interstate, Inc., Freemont, CA (US)

( * ) Notice: Subject to any disclaimer, the term of this patent is extended or adjusted under 35 U.S.C. 154(b) by 0 days.

(21) Appl. No.: 12/692,189

(22) Filed: Jan. 22, 2010

(65) Prior Publication Data

US 2011/0021326 A1 Jan. 27, 2011

Related U.S. Application Data

(60) Provisional application No. 61/228,319, filed on Jul. 24, 2009.

(51) Int. Cl.
*A63B 21/00* (2006.01)

(52) U.S. Cl. ..... 482/83; 482/87; 482/88

(58) Field of Classification Search ..... 482/83–90, 482/148; 446/446, 422, 423, 421; D21/403, D21/406

See application file for complete search history.

(56) References Cited

U.S. PATENT DOCUMENTS

| | | | | | |
|---|---|---|---|---|---|
| 3,019,553 | A * | 2/1962 | Gomez et al. | ..... | 446/422 |
| D317,953 | S * | 7/1991 | Hall | ..... | D21/406 |
| D373,150 | S * | 8/1996 | Zaksenberg | ..... | D21/405 |
| 5,984,761 | A * | 11/1999 | Kalinowski | ..... | 446/421 |
| 2009/0023360 | A1 * | 1/2009 | Wang | ..... | 446/421 |

* cited by examiner

*Primary Examiner* — Jerome W Donnelly
(74) *Attorney, Agent, or Firm* — Luedeka, Neely & Graham, P.C.

(57) ABSTRACT

Embodiments of the invention described herein pertain to a martial arts training device including a first paddle and a second paddle. Each of the first and second paddles have a proximal end and a distal end, the first and second paddles being coupled together at the proximal ends for forming a handle and being separated at the distal ends so that a recess is provided between the distal ends of the first and second paddles. The training device produces a clapping noise when a user strikes the distal end of at least one of the first and second paddles, and a noise enhancement mechanism is disposed in the recess to enhance the clapping noise. A reinforcing member is disposed between the top edges or the bottom edges of the first and second paddles for supporting the recess. The interior surfaces of the distal ends of the first and second paddles include radial supporting ribs extending from an outer region of the interior surfaces towards an inner region of the interior surfaces and protruding from the interior surfaces towards the recess.

20 Claims, 7 Drawing Sheets

CLAPPING MARTIAL ARTS STRIKING TARGET

CROSS-REFERENCE TO RELATED APPLICATION

This application claims priority to provisional application No. 61/228,319 filed Jul. 24, 2009 titled Clapping Martial Arts Striking Target, the entire contents being incorporated herein by reference.

FIELD

This invention relates generally to a martial arts training device. More specifically, this invention relates to a double paddle striking target having noise enhancement capabilities for providing feedback to the user to evaluate one's striking proficiency.

BACKGROUND

Martial arts continue to grow in popularity from novices who use it as an aerobic exercise to the advanced who compete regularly in competitions. Students of martial arts often use training devices such as padded targets for practicing their punching and kicking. These pads are usually held by an instructor or another student.

One type of martial arts training device is the double paddle striking target. This type of padded target provides a "clapping" sound when a user strikes one of the paddles causing the two paddles to come together and contact each other. A disadvantage of this type of striking target is that the "clapping" sound produced after kicking or punching one side of the paddles is often soft, especially for beginning and younger students, and the noise produced is generally the same no matter where the user strikes the target. Furthermore, after frequent use, the separation of the two paddles becomes minimized. Thus, the "clapping" sound becomes softer as the striking target gets older because the paddles are already contacting each other before the user even strikes the target.

Accordingly, it is desirable to provide a striking target having enhanced noise producing capabilities in which the "clapping" sound produced by the double paddle striking target is intensified when the user strikes the correct location of the target. Also, there is a need for increasing the durability of the striking target by providing for the preservation of the separation of the two paddles.

SUMMARY

Embodiments of the invention described herein pertain to a martial arts training device including a first paddle and a second paddle. Each of the first paddle and the second paddle have a proximal end and a distal end, the first paddle and the second paddle being coupled together at the proximal ends for forming a handle and the first paddle and second paddle being separated at the distal ends so that a recess is provided between the distal ends of the first paddle and the second paddle. The martial arts training device produces a clapping noise when a user strikes the distal end of at least one of the first paddle and the second paddle.

According to some embodiments of the invention, a noise enhancement mechanism is disposed in the recess between the distal ends of the first paddle and the second paddle, the noise enhancement mechanism being operable to enhance the clapping noise to produce an enhanced clapping noise when the user strikes the distal end of at least one of the first paddle and the second paddle. The noise enhancement mechanism may be attached to a connecting piece, the connecting piece extending from the noise enhancement mechanism towards the handle for attaching the noise enhancement mechanism to the martial arts training device adjacent the proximal ends of the first paddle and the second paddle. In alternate embodiments, the noise enhancement mechanism is attached to an interior surface of at least one of the first paddle and the second paddle In some embodiments of the invention, the noise enhancement mechanism includes a first noise member disposed adjacent the distal end of the first paddle and a second noise member disposed adjacent the distal end of the second paddle. The first noise member and the second noise member contact each other to produce the enhanced clapping noise when the user strikes the distal end of at least one of the first paddle and the second paddle. In this embodiment, the first noise member and second noise member may be attached to opposing sides of a connecting piece, the connecting piece extending from the first noise member and the second noise member towards the handle for attaching the noise enhancement mechanism to the martial arts training device adjacent the proximal ends of the first paddle and the second paddle. In preferred embodiments, the first noise member and the second noise member are cup shaped and at least partially made of plastic.

According to another embodiment of the invention, the first and second paddles also include a top and bottom edge. A reinforcing member is disposed between at least one of the top edges and the bottom edges of the first paddle and the second paddle for supporting the recess between the distal ends of the first paddle and the second paddle. In preferred embodiments, the reinforcing member includes a first pad member attached to an interior surface of the first paddle and an opposing second pad member attached to an interior surface of the second paddle.

In yet another embodiment of the invention, the interior surfaces of the distal ends of the first paddle and the second paddle include radial supporting ribs extending from an outer region of the interior surfaces towards an inner region of the interior surfaces, the radial supporting ribs also protruding from the interior surfaces of the first paddle and the second paddle towards the recess.

BRIEF DESCRIPTION OF THE DRAWINGS

Further advantages of the invention are apparent by reference to the detailed description in conjunction with the figures.

DETAILED DESCRIPTION

Figure 1:
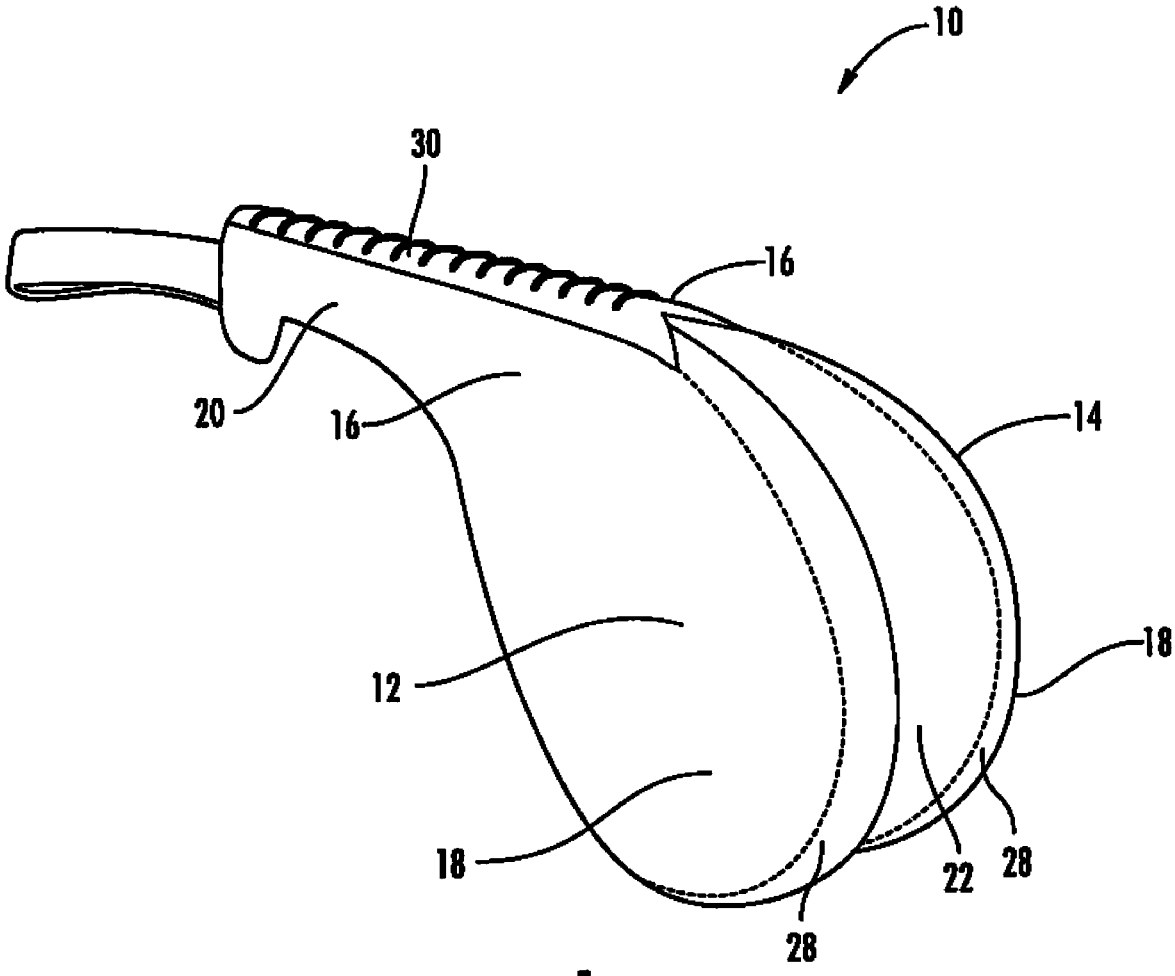
FIG. 1 depicts a perspective view of a double paddle striking target.

Referring to FIG. 1, a double paddle striking target 10 is shown having a first paddle 12 and a second paddle 14, the first and second paddles 12 and 14 each having a proximal end 16 and a distal end 18. The first and second paddles 12 and 14 are coupled together at the proximal ends 16 to form a handle 20 and are separated at the distal ends 18 so that a recess 22 is provided between the distal ends 18 of the first and second paddle 12 and 14. The first and second paddles 12 and 14 are separated at the distal ends 18 so that a "clapping" noise occurs when a user strikes the distal end 18 of either the first or second paddle 12 or 14, thereby forcing the paddles 12 and 14 to come together and contact each other.

Figure 2:
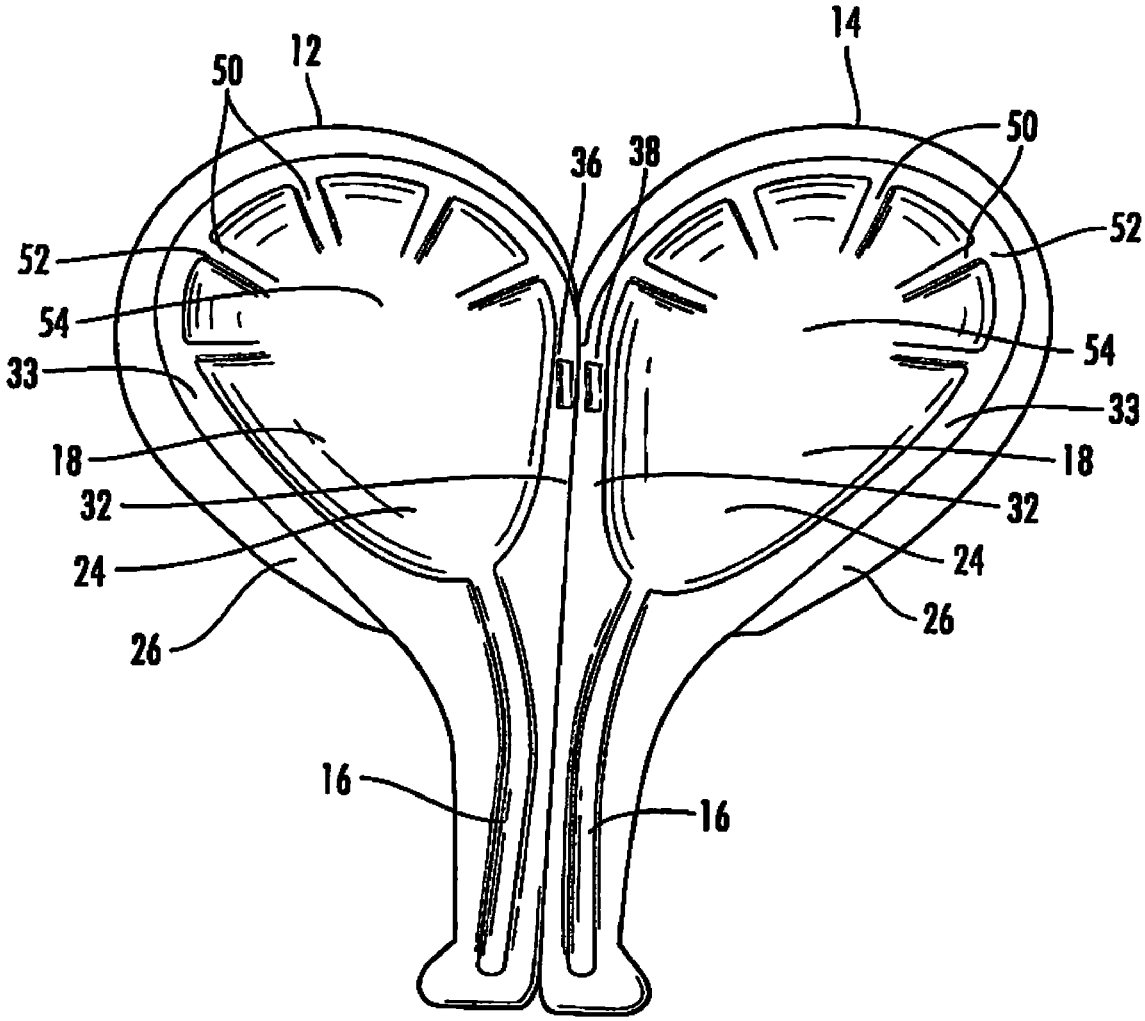
FIG. 2 depicts an interior view of the double paddle striking target according to an embodiment of the present invention.

As shown in FIG. 2 where the first and second paddles 12 and 14 of the striking target 10 have been separated, each of the first and second paddles 12 and 14 preferably includes a plastic interior surface 24 and a foam padded exterior surface 26 to provide cushioning for the paddles 12 and 14. A protective jacket 28 (as depicted in FIG. 1) is wrapped around the first and second paddles 12 and 14 to cover the handle 20, the foam padded exterior surface 26 of the first and second paddles 12 and 14, and the plastic interior surface 24 of the first and second paddles 12 and 14. The protective jacket 28 covers the plastic interior surfaces 24 at least at the distal ends 18 of the first and second paddles 12 and 14. In preferred embodiments, the protective jacket 28 is fastened by threads 30 along top edges 32 of the first and second paddle 12 and 14 for extra support. The protective jacket 28 is preferably a vinyl or leather material.

Figures 3, 3A:
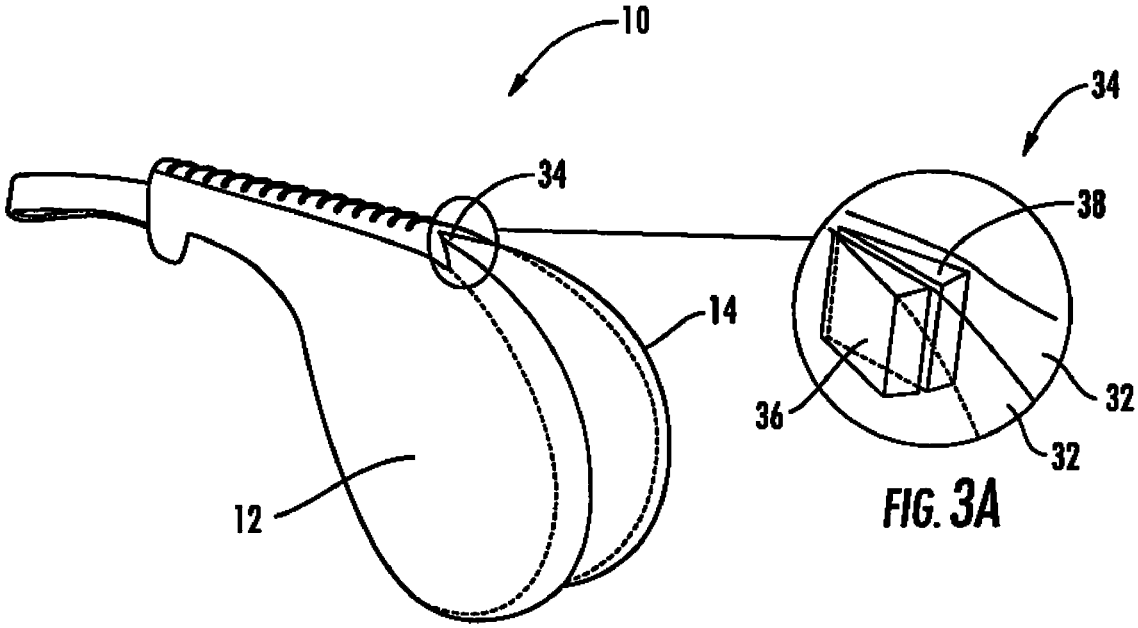
FIG. 3 depicts a perspective view of a double paddle striking target.
FIG. 3A depicts an exploded view of the reinforcing member of FIG. 3 according to an embodiment of the present invention.

Referring to FIG. 3, the top edges 32 of the first and second paddle 12 and 14 may include a reinforcing member 34 for further supporting the separation of the first and second paddles 12 and 14. As depicted in FIG. 2 and the exploded view in FIG. 3A, the reinforcing member 34 preferably includes a first pad 36 connected to the plastic interior surface 24 of the first paddle 12 and an opposing second pad 38 connected to the plastic interior surface 24 of the second paddle 14 whereby the pads 36 and 38 contact each other at least when the user kicks or punches the striking target 10. The contact between the pads 36 and 38 helps to prevent the first and second paddles 12 and 14 from colliding with each other at the top edges 32 of the first and second paddle 12 and 14. Thus, the reinforcing member helps the paddles 12 and 14 hold the shape of the striking target 10 longer, aids in the preservation of the separation between the first and second paddles 12 and 14, and improves and sustains the sound levels when the paddles 12 and 14 are "clapped" together.

In alternate embodiments, the reinforcing member 34 may include only one pad connected to the plastic interior surface 24 of either the first or second paddle 12 or 14. A reinforcing member 34 may also be attached along a bottom edge 33 of the first and second paddles 12 and 14 and either used in conjunction with the reinforcing member 34 of the top edges 32 or without the reinforcing member 34 of the top edges 32.

In preferred embodiments, the first and second pads 36 and 38 of the reinforcing member 34 are soft plastic. However, the pads could also be composed of other impact absorbing materials such as foam insulation, rubber, etc.

Figures 4, 4A:
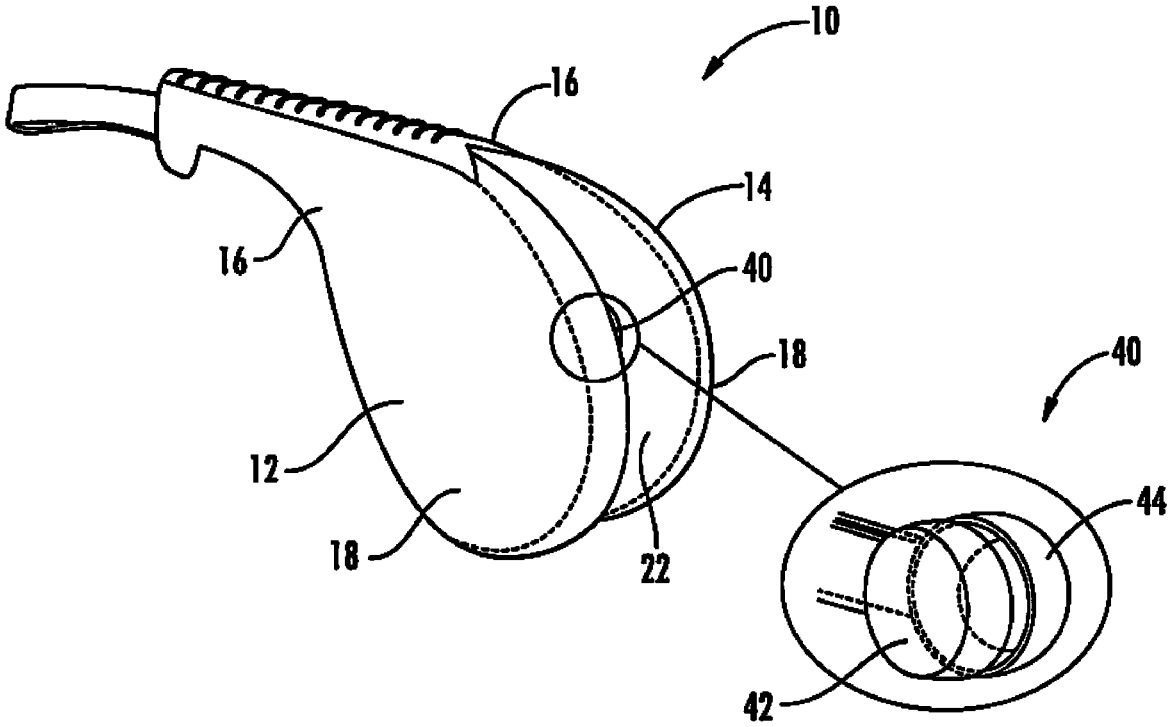
FIG. 4 depicts a perspective view of a double paddle striking target including the noise enhancement mechanism according to an embodiment of the present invention.
FIG. 4A depicts an exploded view of the noise enhancement mechanism of FIG. 4 according to an embodiment of the present invention.
Figure 5:
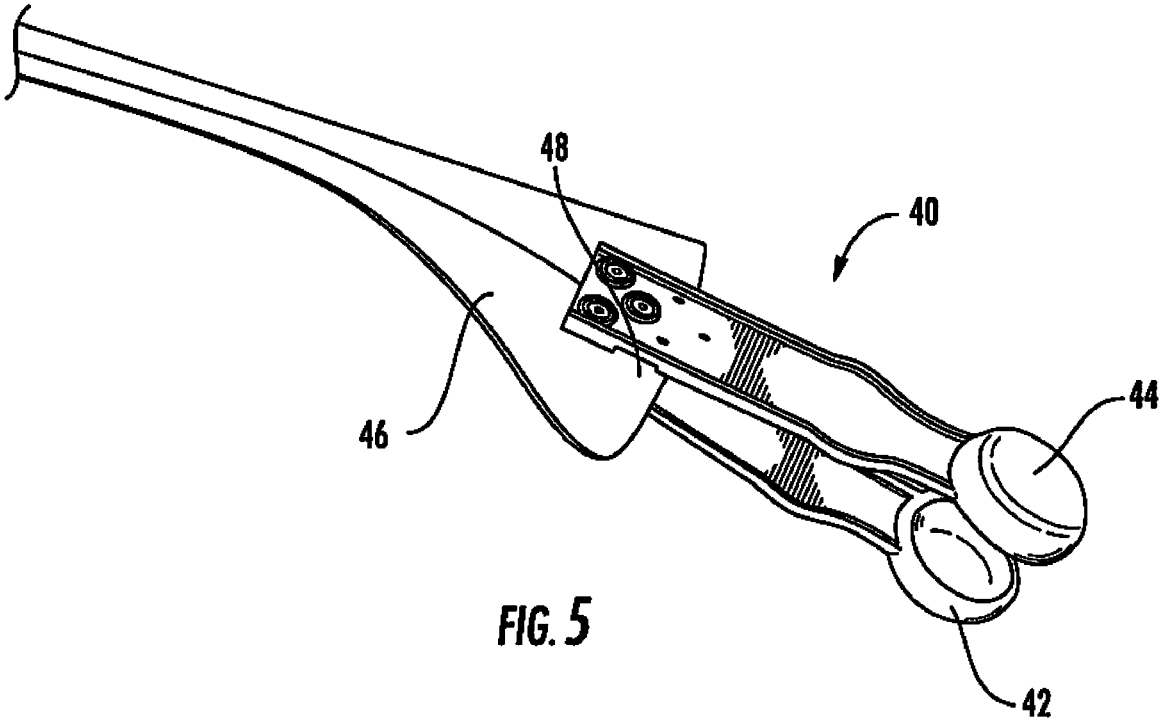
FIG. 5 depicts the noise enhancement mechanism of FIGS. 4 and 4A according to an embodiment of the present invention.
Figure 6:
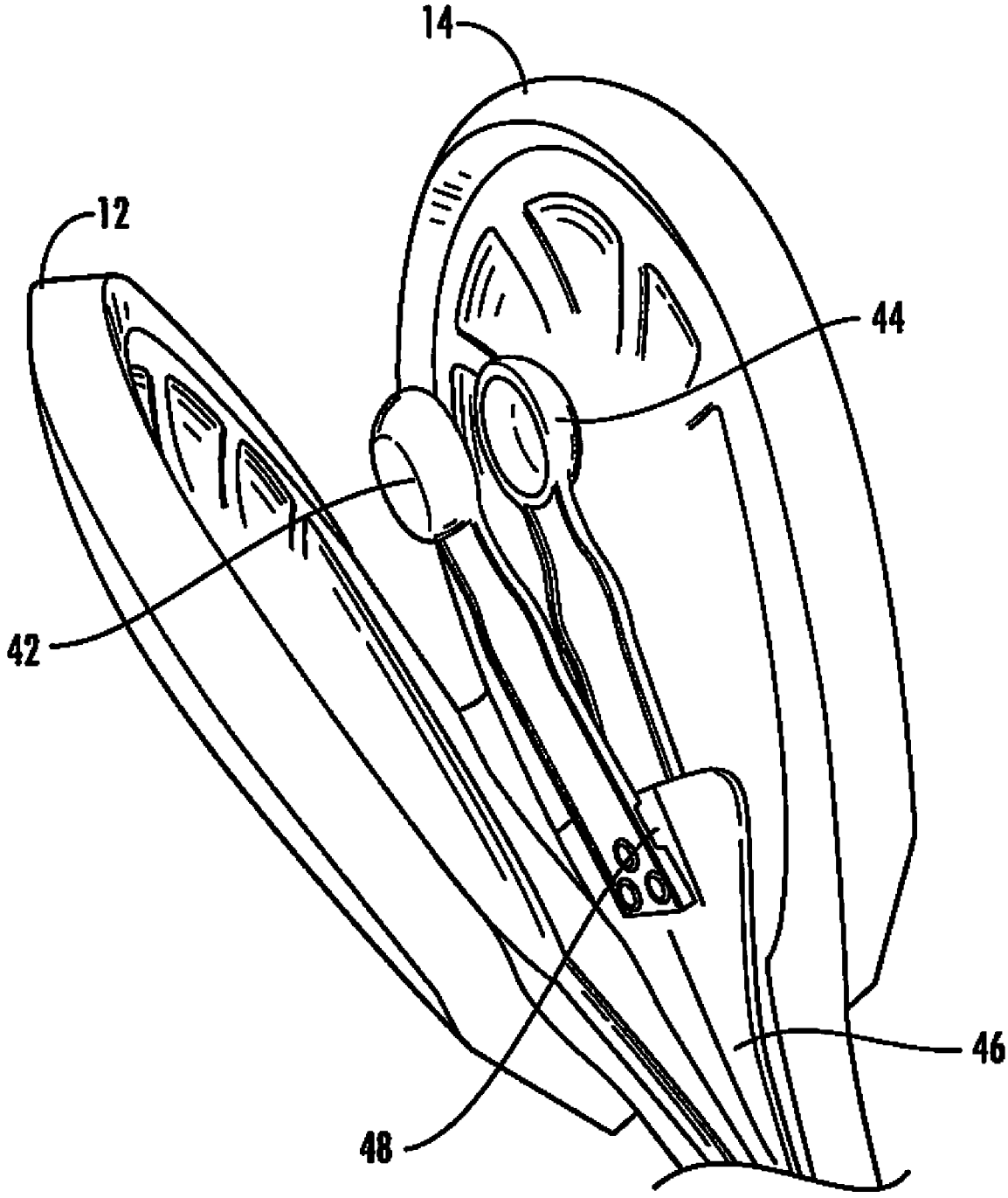
FIG. 6 depicts an interior view of the double paddle striking target including the noise enhancement mechanism according to an embodiment of the present invention.

As shown in FIGS. 4-6, other embodiments of the invention include a noise enhancement mechanism 40 disposed in the recess 22 between the first paddle 12 and second paddle 14 to further enhance the sound level when the paddles are "clapped" together. The noise enhancement mechanism 40 is preferably disposed adjacent the center of the paddles 12 and 14 toward their distal ends 18 so that the user is rewarded with a louder and more consistent sound when he or she strikes the center of the striking target 10. In addition to enhancing the "clapping" noise, the noise enhancement mechanism 40 may also aid in the preservation of the separation between the first and second paddles 12 and 14 by preventing the recess 22 between the paddles from closing or gradually becoming narrower after prolonged use.

As depicted in FIGS. 5-6 and the exploded view in FIG. 4A, the noise enhancement mechanism 40 preferably includes two noise members shaped like cups. The two cups are separated with the first noise member 42 disposed adjacent the first paddle 12 and the second noise member 44 disposed adjacent the second paddle 14. Thus, when the user strikes the striking target 10, the first and second noise member 42 and 44 contact each other to produce an enhanced clapping sound when the first and second paddles 12 and 14 come together. This cup-like design may also help to keep proper separation between the first and second paddles 12 and 14 before the user kicks or punches the striking target 10.

To connect the noise enhancement mechanism 40 to the striking target 10 adjacent the proximal ends 16 of the first and second paddles 12 and 14, a connecting piece 46 is provided for disposing the noise enhancement mechanism in the recess 22. Referring to FIGS. 5-6, the connecting piece 46 is disposed between the first and second paddles 12 and 14 and extends towards the handle 20 of the striking target. To provide separation between the first and second noise members 42 and 44 of the noise enhancement mechanism 40, the noise members are attached to opposing sides of the connecting piece 46. A block or wedge type structure 48 may also be provided where the noise members are attached to the connecting piece 46 to increase the separation between the first and second noise members 42 and 44.

While the noise enhancement mechanism 40 is depicted in FIGS. 4-6 as including first and second cups, other noise enhancement mechanism designs are possible. Thus, the first and second noise members 42 and 44 do not have to be "cup shaped," but can be a variety of shapes. For example, the first and second noise members 42 and 44 may be any type of shape having an opening or gap that will produce a clapping sound, or may even simply be two blocks or wedges disposed between the first and second paddles 12 and 14. Furthermore, while the noise enhancement mechanism 40 and first and second noise members 42 and 44 are preferably made at least partially of plastic for cost and efficiency reasons, they do not necessarily have to be made of plastic. Other materials may be used such as rubber, wood, metal, etc.

In another embodiment, only one noise member may be desirable. In this embodiment, the noise enhancement mechanism 40 produces an enhanced sound by the single noise member simply contacting the plastic interior surfaces 24 of the first and second paddles 12 and 14 instead of also contacting a second noise member. In yet another embodiment, the first and second noise members 42 and 44 may face toward the interior surfaces 24 of the first and second paddles 12 and 14 so that the rear of the noise members contact each other when the striking target 10 is struck, and the front of the noise members (i.e., the opening portion of the noise member when the noise members are cup shaped) contact the interior surfaces 24 of the paddles.

In an alternate embodiment of the invention, the noise enhancement mechanism 40 may be attached to the interior surfaces 24 of the first and second paddles 12 and 14 instead of being disposed in the recess 22 by the connecting piece 46. For example, a first plastic piece may be attached to the interior surface 24 of the first paddle 12 and a second plastic piece may be attached to an opposing portion of the interior surface 24 of the second paddle 14. Thus, when a user strikes the striking target 10, the two plastic pieces contact each other to enhance the "clapping" of the first and second paddles 12 and 14.

Figures 7, 7A:
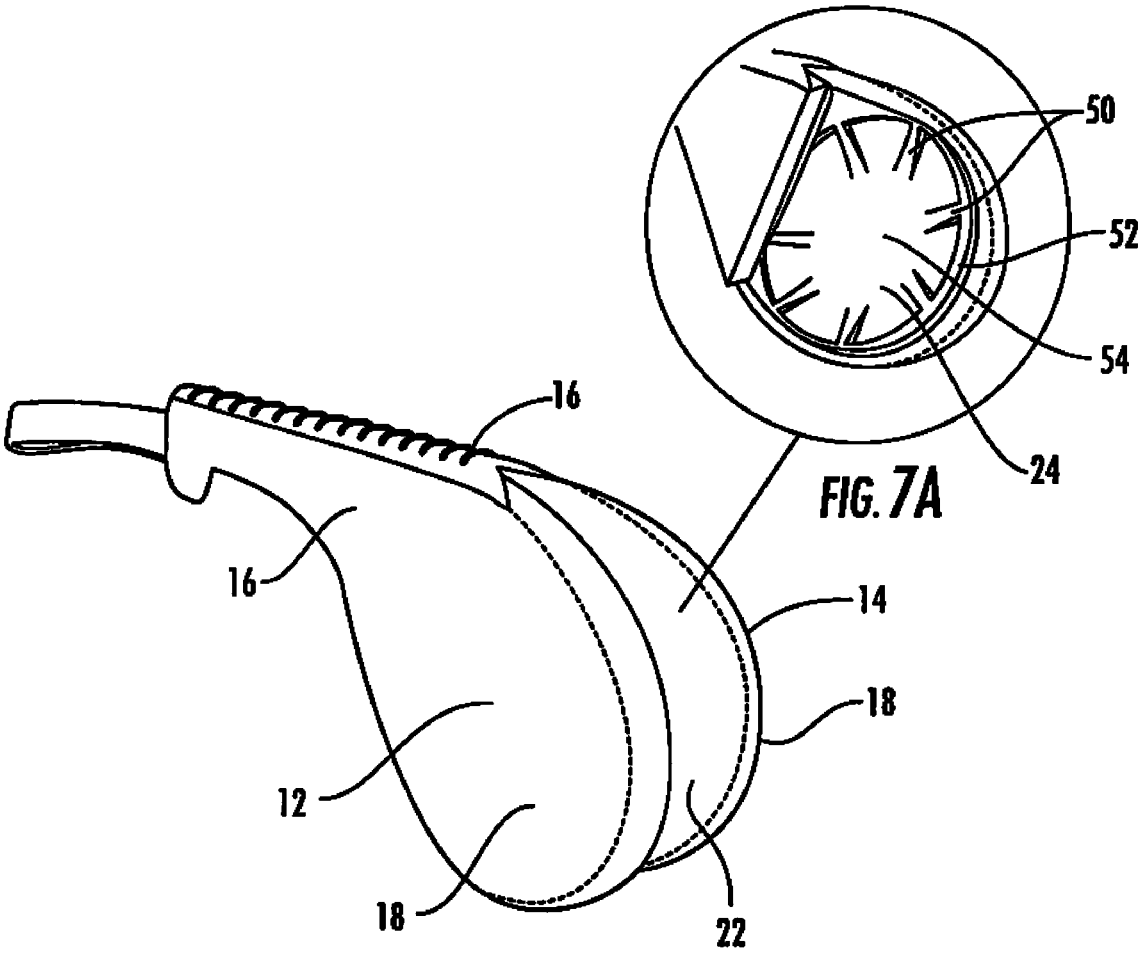
FIG. 7 depicts a perspective view of the double paddle striking target.
FIG. 7A depicts an exploded view of the interior surface of one of the paddles of the double paddle striking target according to an embodiment of the present invention.

FIGS. 2 and 7A depict a preferable design of the plastic interior surface 24 of the paddles 12 and 14. As shown in FIG. 2 and the exploded view in FIG. 7A, the distal ends 18 of the first and second paddles 12 and 14 include radial supporting ribs 50 extending from the outer region 52 of the first and second paddles 12 and 14 towards the inner region 54 like spokes on a wheel. The radial supporting ribs 50 protrude from the plastic interior surface 24 towards the recess 22 between the first and second paddles 12 and 14. The radial supporting ribs 50 help create air pockets when the first and second paddles 12 and 14 are "clapped" together. The production of air pockets gives the striking target 10 and respective paddles 12 and 14 more durability while enhancing the sound of the noise enhancement mechanism 40.

In preferred embodiments, the striking target 10 includes all of the features described above such as the reinforcing member 34 disposed along the top edges 32 of the striking target 10, the noise enhancement mechanism 40 disposed in the recess 22 between the first and second paddle 12 and 14, and the radial supporting ribs 50 extending from the outer regions 52 of the first and second paddles 12 and 14 towards the inner regions 54. However, embodiments of the striking target 10 may include any of these features independently of each other. Furthermore, while the striking target 10 has been described with reference to a hand-held training device, features of the invention may also be included in striking targets attached to various martial arts training equipment and apparatuses. For example, the handle 20 of the striking target 10 of the invention may be attached to the particular training apparatus instead of being held by a sparring partner.

The foregoing description of preferred embodiments for this invention has been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention.

What is claimed is:

1. A martial arts training device comprising:

a first paddle and a second paddle each having a proximal end and a distal end, the first paddle and the second paddle being coupled together at the proximal ends for forming a handle and the first paddle and the second paddle being separated at the distal ends so that a recess is provided between the distal ends of the first paddle and the second paddle, the distal ends of the first and second paddles each including a padded exterior surface, wherein a clapping noise is produced when a user strikes the distal end of at least one of the first paddle and the second paddle; and a noise enhancement mechanism disposed in the recess between the distal ends of the first paddle and the second paddle, the noise enhancement mechanism operable to enhance the clapping noise to produce an enhanced clapping noise when the user strikes the distal end of at least one of the first paddle and the second paddle.

2. The martial arts training device according to claim 1 wherein the first paddle and second paddle each have a top edge and a bottom edge and the training device further comprises a reinforcing member disposed between at least one of the top edges and the bottom edges of the first paddle and the second paddle for supporting the recess between the distal ends of the first paddle and the second paddle.

3. The martial arts training device according to claim 2 wherein the first paddle and the second paddle each have an interior surface, the interior surfaces of the distal ends of the first paddle and the second paddle including radial supporting ribs extending from an outer region of the interior surfaces towards an inner region of the interior surfaces, the radial supporting ribs protruding from the interior surfaces of the first paddle and the second paddle towards the recess.

4. The martial arts training device according to claim 1 wherein the first paddle and the second paddle each have an interior surface, the interior surfaces of the distal ends of the first paddle and the second paddle including radial supporting ribs extending from an outer region of the interior surfaces towards an inner region of the interior surfaces, the radial supporting ribs protruding from the interior surfaces of the first paddle and the second paddle towards the recess.

5. The martial arts training device according to claim 1 wherein the noise enhancement mechanism further comprises a first noise member disposed adjacent the distal end of the first paddle and a second noise member disposed adjacent the distal end of the second paddle wherein the first noise member and the second noise member contact each other to produce the enhanced clapping noise when the user strikes the distal end of at least one of the first paddle and the second paddle.

6. The martial arts training device according to claim 5 wherein the first noise member and the second noise member are cup shaped.

7. The martial arts training device according to claim 5 wherein the first noise member and second noise member are at least partially made of plastic.

8. The martial arts training device according to claim 5 wherein the first noise member and the second noise member are attached to opposing sides of a connecting piece, the connecting piece extending from the first noise member and the second noise member towards the handle for attaching the noise enhancement mechanism to the martial arts training device adjacent the proximal ends of the first paddle and the second paddle.

9. The martial arts training device according to claim 1 wherein the noise enhancement mechanism is attached to a connecting piece, the connecting piece extending from the noise enhancement mechanism towards the handle for attaching the noise enhancement mechanism to the martial arts training device adjacent the proximal ends of the first paddle and the second paddle.

10. The martial arts training device according to claim 1 wherein the noise enhancement mechanism is attached to an interior surface of at least one of the first paddle and the second paddle.

11. A martial arts training device comprising:

a first paddle and a second paddle each having a top edge, a bottom edge, a proximal end, and a distal end, the first paddle and the second paddle being coupled together at the proximal ends for forming a handle and the first paddle and the second paddle being separated at the distal ends so that a recess is provided between the distal ends of the first paddle and the second paddle, wherein a clapping noise is produced when a user strikes the distal end of at least one of the first paddle and the second paddle; and a reinforcing member disposed between at least one of the top edges and the bottom edges of the first paddle and the second paddle for supporting the recess between the distal ends of the first paddle and the second paddle.

12. The martial arts training device according to claim 11 wherein the first paddle and the second paddle each have an interior surface, the interior surfaces of the distal ends of the first paddle and the second paddle including radial supporting ribs extending from an outer region of the interior surfaces towards an inner region of the interior surfaces, the radial supporting ribs protruding from the interior surfaces of the first paddle and the second paddle towards the recess.

13. The martial arts training device according to claim 11 wherein the reinforcing member further comprises a first pad member attached to an interior surface of the first paddle and an opposing second pad member attached to an interior surface of the second paddle.

14. The martial arts training device according to claim 11 wherein the reinforcing member is attached to at least one of the top edges of the first paddle and the second paddle.

15. The martial arts training device according to claim 14 wherein the reinforcing member comprises a first pad member attached to the top edge of the first paddle and an opposing second pad member attached to the top edge of the second paddle.

16. The martial arts training device according to claim 15 further comprising a noise enhancement mechanism disposed in the recess between the distal ends of the first paddle and the second paddle, the noise enhancement mechanism including a first noise member disposed adjacent the distal end of the first paddle and a second noise member disposed adjacent the distal end of the second paddle, wherein the first noise member and the second noise member contact each other to enhance the clapping noise produced when the user strikes the distal end of at least one of the first paddle and the second paddle.

17. The martial arts training device according to claim 16 wherein the first noise member and the second noise member are attached to opposing sides of a connecting piece, the connecting piece extending from the first noise member and the second noise member towards the handle for attaching the noise enhancement mechanism to the martial arts training device adjacent the proximal ends of the first paddle and the second paddle.

18. The martial arts training device according to claim 17 wherein the first paddle and the second paddle each have an interior surface, the interior surfaces of the distal ends of the first paddle and the second paddle including radial supporting ribs extending from an outer region of the interior surfaces towards an inner region of the interior surfaces, the radial supporting ribs protruding from the interior surfaces of the first paddle and the second paddle towards the recess.

19. The martial arts training device according to claim 18 wherein the first noise member and second noise member are cup shaped and are at least partially made of plastic.

20. A martial arts training device comprising a first paddle and a second paddle each having a proximal end, a distal end, and an interior surface, the first paddle and the second paddle being coupled together at the proximal ends for forming a handle and the first paddle and the second paddle being separated at the distal ends so that a recess is provided between the distal ends of the first paddle and the second paddle, the interior surfaces of the distal ends of the first paddle and the second paddle including radial supporting ribs extending from an outer region of the interior surfaces towards an inner region of the interior surfaces and protruding from the interior surfaces of the first paddle and the second paddle towards the recess, wherein a clapping noise is produced when a user strikes the distal end of at least one of the first paddle and the second paddle.

* * * * *